United States Patent [19]

Fildan

[11] Patent Number: 4,691,951

[45] Date of Patent: Sep. 8, 1987

[54] BOLT ASSEMBLY FOR A DOOR SET

[76] Inventor: Gerhard Fildan, D-7250 Leonberg, Fed. Rep. of Germany

[21] Appl. No.: 864,441

[22] Filed: May 16, 1986

[30] Foreign Application Priority Data

Oct. 19, 1985 [DE] Fed. Rep. of Germany ... 8529711[U]
Dec. 30, 1985 [DE] Fed. Rep. of Germany ... 8536672[U]

[51] Int. Cl.[4] ..... E05C 1/16

[52] U.S. Cl. ..... 292/337; 292/DIG. 60; 292/173

[58] Field of Search ..... 292/DIG. 60, 337, 173, 292/1

[56] References Cited

U.S. PATENT DOCUMENTS 1,880,251 10/1932 Hornung ..... 292/173
2,937,897 5/1960 Soderberg ..... 292/337 X

FOREIGN PATENT DOCUMENTS 375722 9/1984 Austria .

*Primary Examiner*—Richard E. Moore
*Attorney, Agent, or Firm*—Karl F. Ross; Herbert Dubno; Ronald Lianides

[57] ABSTRACT

A door set has its door knob engageable with a bolt pin through an eye which is formed in one piece with a screw threaded into a shank of the bolt pin to enable axial adjustment of the effective length of the bolt. The relative rotation of the shank and of the screw can be effected from within or even by rotation of the bolt, for which purpose flats can be provided on the bolt and on a sleeve in which the bolt is guided. The threaded portion of the screw can be provided on ribs which can pass axially along grooves in the internal thread on the shank of the bolt.

18 Claims, 10 Drawing Figures

BOLT ASSEMBLY FOR A DOOR SET

CROSS REFERENCE TO RELATED APPLICATION

This application is related to my design patent application Ser. No. 794,160 filed Nov. 1, 1985.

FIELD OF THE INVENTION

My present invention relates to a door assembly for a door set and, more particularly, to a bolt assembly having improved means enabling the adjustment of the distance between the end of the sleeve of a bolt and the actuator of the door set which effects the displacement of the bolt.

BACKGROUND OF THE INVENTION

A door set generally comprises at least one door knob rotatable in a housing structure adapted to be mounted on a door and coupled by an actuating formation, generally referred to as eccentric formation or eccentric pin, with the bolt of a bolt assembly extending through the edge of the door to permit the head of the bolt to emerge from this assembly and engage a strike in a door post.

The bolt assembly can include a sleeve which extends through a bore in the edge of the door meeting the bore in which the housing is mounted and a spring which can be provided in the sleeve to urge the head of the bolt within the sleeve into engagement with the strike. This spring can be a coil spring. The bolt assembly can be coupled by an end of its shank to the eccentric pin connected to the door knob so that the arcuate movement of the eccentric pin will be translated into a linear displacement of the bolt against the force of the spring when the door know is rotated to draw the bolt head out of a strike.

It has been proposed to provide this connecting element as a hook which is formed as part of the bolt pin. This not only has the disadvantage that fabrication of the one piece bolt pin is complex and expensive, but also the drawback that axial adjustment of the distance between the bolt head or the effective end of the bolt and the eccentric pin is not possible.

The latter disadvantage is particularly acute when it is understood that frequently the center of rotation of the door knob may not be precisely located with respect to the edge of the door as may be desired.

Austrian patent No. 375,722, therefore, teaches an improvement in which the connecting hook is tied to the bolt pin or bolt head by a screw, the latter extending longitudinally through the bolt and allowing a swinging movement of the hook which is nevertheless precluded from rotating once the axial positions are established.

In this construction, the screw extends the full length of the bolt so that it can be adjusted from an end of the bolt. Between the bolt and the connecting hook a spacer compression spring can be provided. This assembly permits the position of the hook and hence the location of the eccentric pin to be adjusted relative to the strike.

This arrangement, of course, is able to overcome the drawback of nonadjustability mentioned earlier and also has the advantage that the hook is subjected to little bending stress. However, it has the important disadvantage that it is made up of many parts, namely, the bolt itself, the hook, the screw, the associated support washer and the spacer compression spring. Not only is this problematical because assembly is time consuming and misplacing of a part may render the entire unit useless, but the fabrication costs of such a door set are inordinately increased by the excess number of parts and the need to assemble them.

OBJECTS OF THE INVENTION

It is, therefore, the principal object of the present invention to provide an improved bolt assembly which provides the advantages of the assembly last described without the drawbacks thereof.

Another object of the present invention is to provide an improved bolt assembly for the purposes described which has fewer parts and can be comparatively easily adjusted with respect to the position of the end of the bolt with respect to the eccentric pin in rest positions thereof.

It is also an object of this invention to provide a bolt assembly for a door set of the type described which simplifies adjustment of the distance between the end of the bolt and the eccentric pin and, moreover, simplifies the manner in which the adjustment may be made.

SUMMARY OF THE INVENTION

These objects and others which will become apparent hereinafter are attained, in accordance with the invention, in a bolt assembly which comprises the aforementioned sleeve receiving the coil spring and within which the bolt pin is axially displaceable so that a bolt head can project from the sleeve and engage a door strike, the bolt pin having a shank which is internally threaded and is engaged by the male thread of a screw formed unitarily with an eye projecting from the sleeve and engageable with the eccentric pin of the door knob which is rotatable on the door set housing. Reference may be made to this "eye" below and it should be understood that the eye, for the purposes of this invention, can be completely closed around the eccentric pin or, as is the preferred case, can be a hook which engages around this pin, i.e. does not completely surround it.

According to a feature of the invention, moreover, the internal thread of the shank is interrupted by a plurality of longitudinally extending grooves while the male thread is provided on the screw in a corresponding number of ridges so that in one relative angular position of the screw and the shank the ridges can pass axially through the grooves to permit quick adjustment of the relative axial position and then relative rotation can set this position and even permit further fine adjustment by the screw action.

More specifically the bolt assembly for a door set having at least one rotatable knob, according to the invention comprises:

a bolt guide sleeve;

a bolt pin axially displaceable in the sleeve, the bolt pin having a latching head adapted to project from the sleeve and engage in a recess, and a tubular shank extending from the head in the sleeve; a coil spring braced against the sleeve and disposed therein for yieldably urging the head out of the sleeve;

a screw threadedly engaged in the shank and axially displaceable therein by rotation of the screw relative to the bolt pin; and an eye formed unitarily and integrally (in one piece) on the screw and extending therefrom away from the head for engagement with a formation connected to the knob and excentric with respect to an axis of rotation thereof whereby rotation of the knob can displace the head against a force of the spring.

The eye can have a transition region at which it merges with the screw and which is of reduced cross section.

The screw can have a head at which the eye is formed thereon and which is provided with at least one slot engageable by a screwdriver. The screw can have an end received in the bolt pin which is of reduced cross section.

Advantageously the bolt pin has an axially throughgoing bore opening at the head, the end of the screw which is of reduced cross section being provided with at least one slot adapted to receive a screwdriver inserted through the throughgoing bore of the head. The bolt guide sleeve can be provided with an elongated window in a wall thereof dimensioned to permit insertion of the screw into the sleeve and into threaded engagement with the shank, and with a pair of elongated holes adapted to be traversed by respective connecting screws of a door plate on which the knob is rotatably mounted.

The bolt pin can be provided with a flat and the sleeve has at least one flat complementary to the flat on the bolt pin for preventing rotation of the bolt pin relative to the sleeve upon engagement of the flats.

The flat on the sleeve can be formed by an elastic flap bearing resiliently upon the bolt pin and defined by a pair of axially spaced radial slits and an axial gap interconnecting the slits.

Preferably the bolt pin can be provided with a pair of diametrically opposite flats and two the flaps are provided on the sleeve for resilient engagement respectively with the flats of the bolt pin, the flaps extending at least over the angular extent of the flats.

As noted the shank can have an internal thread receiving the screw and provided with a plurality of axially extending inwardly open grooves interrupting the internal thread, the screw being formed with a male thread on a plurality of ridges equal in number to that of the grooves and receivable therein in a given relative angular orientation of the shank and the screw permitting axial insertion of the screw in the shank to a desired distance and then permitting relative rotation of the screw and the shank to adjust the relative axial positions thereof.

Of course the eye can be a hook which is partially open to engage over the formation.

It will be appreciated that the systems described allows not only adjustment of the bolt assembly when the door set is mounted, but also adjustment after the bolt assembly is in place simply by rotating the bolt into a position in which a flat on the shank engages one of the resilient flaps of the sleeve.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
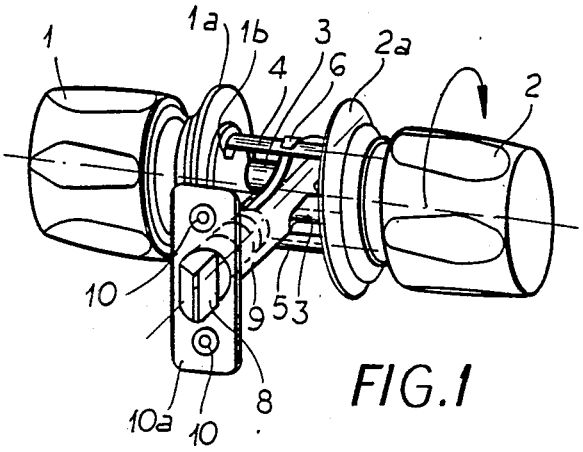
FIG. 1 is a perspective view of a door set according to the invention.

The bolt assembly of the present invention can be used in a door set of the type shown in FIG. 1 which can comprise two door knobs which can be rotatable and can be under key control or not as required, carried by a housing, two plates of which have been shown at 1*a* and 2*a* in FIG. 1, respectively.

The housing parts are connected by screws 17 passing through sleeves 17*u* molded unitarily with the plates 1*a* and 2*a* which can be injection molded from a synthetic resin material. The connecting elements consisting of the sleeves and the screws just described are represented at 3 in FIG. 1 and constitute a pair of guide pins located one behind the other for the bolt assembly 6, 8, 9 and 10 represented in FIG. 1. The door knobs 1 and 2 are coupled for joint rotation by a pair of eccentric pins 4 and 5 which are arcuately displaceable in respective arcuate slots one of which can been at 1*b* in FIG. 1. The pin 4 is engaged by a spring hook 6 which, upon rotation of the hook through 180° from its position shown, can alternatively engage the pin 5.

Figure 2:
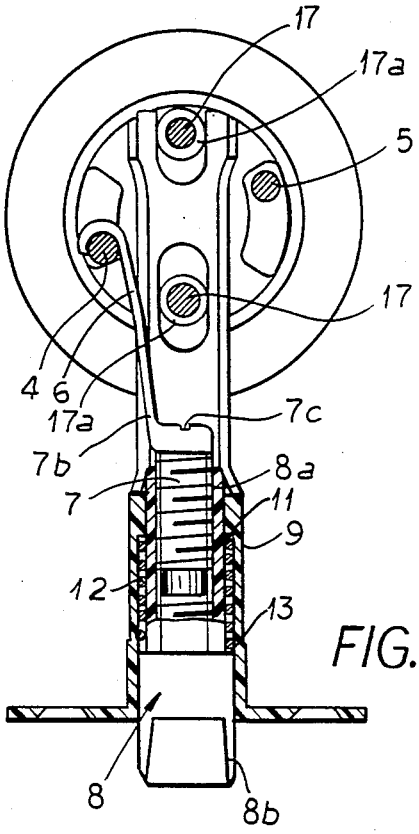
FIG. 2 is an axial section through the bolt assembly according to the invention showing the bolt pin partially in elevation and partially in section.

As can be seen from FIG. 2, the hook 6 is formed unitarily with a screw 7 which can be injection molded thereon.

The screw 7 is threadedly received in an internally threaded shank 8*a* of a bolt pin 8 whose head 8*b* emerges from a sleeve 9 in which the bolt pin 8 is axially shiftable against the force of a spring 12 braced upon a shoulder 9*a* of the sleeve 9.

The spring 12 also bears upon a shoulder 8*c* of the head 8*b* projecting outwardly beyond the shank 8*a*. The shank 8*a* is internally threaded as has been noted so that the screw 7 can be advanced in this shank by rotation to adjust the effective length of the bolt, i.e. the distance between the hook 6 and the end of the bolt head 8*b* which can engage in the usual manner in a door strike.

As can be seen from FIG. 1 as well, the sleeve 9 is inserted through the edge of the door in a bore which is perpendicular to the bore made for receiving the housing 1*a*, 2*a* and can be attached in the door by screws through holes 10 of a plate 10*a* which can be formed unitarily on the sleeve. The sleeve can be molded from plastic unitarily with this plate.

Figure 2C:
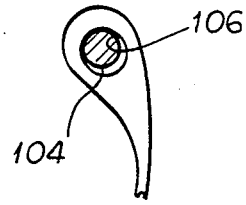
FIG. 2C is a detail view showing a closed eye engaging the eccentric pin.
Figure 2A:
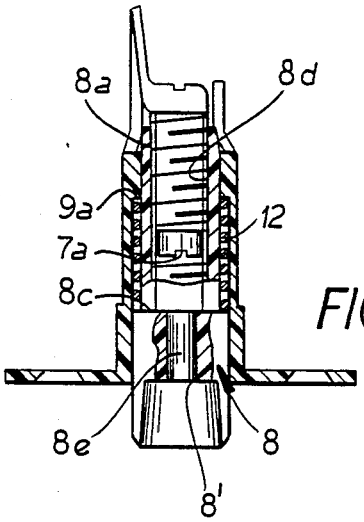
FIG. 2A is a detail of the bolt assembly in section of FIG. 2 with another portion of the bolt broken away.
Figure 2B:
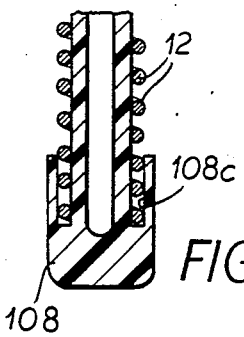
FIG. 2B is a section through the bolt pin in another embodiment of the invention.

As can be seen from FIG. 2B moreover, the head 108 can be turned to form a recess 108*c* receiving the spring when different size bolt assembly is required.

As is apparent from FIG. 2C, moreover, instead of a hook, a closed eye 106 can surround the eccentric pin 104 and can be formed unitarily with the screw.

Consequently, upon rotation of one of the knobs 1, 2, the pin 4 can be displaced rearwardly (FIG. 1) to draw the bolt 8 into the sleeve and out of a door strike.

When the door is closed, moreover, the bolt can be pressed inwardly against the force of the spring which normally passes the bolt head outwardly for engagement with the strike.

Figure 3:
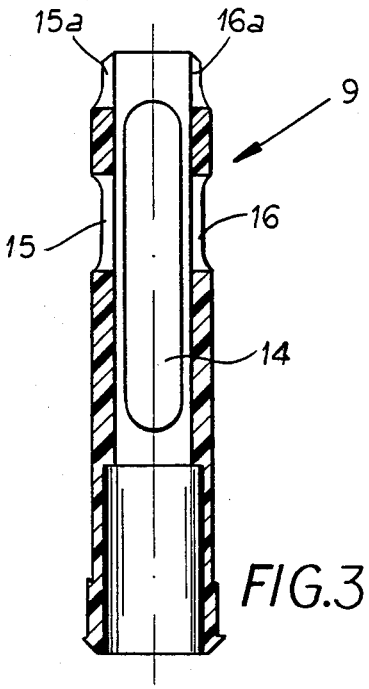
FIG. 3 and 3A are axial sections through a sleeve of the assembly, the two sections being taken in sectional planes at right angles to one another.
Figure 3A:
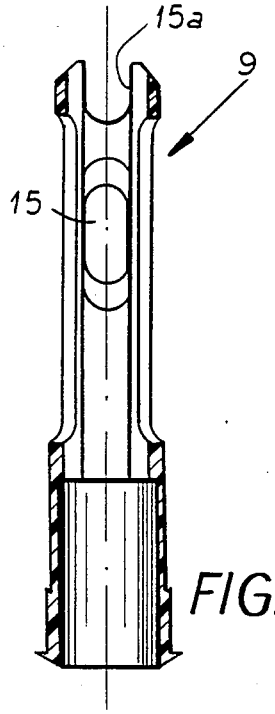

From FIGS. 2 and 2A, moreover, it will be apparent that the hook 6 projects laterally outwardly from an elongated slot 14, two such slots being provided diametrically opposite one another on the sleeve as can be seen from FIGS. 3 and 3A. At right angles to these slots, the sleeve 9 is also formed with a pair of aligned slots 15, 16 adapted to be traversed by one of the guide pins 3, the rear end of the sleeve being notched at 15*a*, 16*a* to engage the other guide pin 3.

When the door knob is released after it has been rotated to draw in the bolt, the coil compression spring 12 restores it angularly to its normal position by pressing the bolt 8 outwardly. The bolt 8 is coupled by the hook 6 with the door knob.

From FIG. 2A it will be apparent that the threaded bore 8*d* of the shank 8*a* is coaxial with a bore 8*e* of reduced diameter which can extend to the front end 8' of the bolt head.

The elongated openings 15 and 16 prevent rotation of the sleeve 9 on the pins 3 while the passage of the hook 6 through one of the windows 14 can prevent rotation of the hook and its screw 7 once the proper position of the hook relative to the bolt pin 8 has been reached.

The reduced cross section head 7*a* provided with a slot or pair of cross slots for a screwdriver is provided at the end of the screw 7 remote from the reduced cross section junction 7*b* of the hook 6 with this screw. Furthermore, a screw slot 7*c* can be provided at this end of the screw as well.

Thus with the hook 6 released from the pin 4 and pressed into the sleeve, or prior to assembly, a screwdriver can be inserted through the bore 8*e* or can engage the screw 7 from the opposite end to rotate the screw 7 in the bolt pin 8 by the required number of turns to adjust the effective axial length.

Flats can be provided on the shank 8*a* and in the sleeve 9 to establish the desired angular orientation for the bolt and the hook 6 can be provided so that it can spring beneath the eccentric pin if desired.

FIG. 2A differs from FIG. 2 in that it allows rotation of the screw from the exterior through the hole 8*e*, whereas the embodiment of FIG. 2 does not.

Figure 4A:
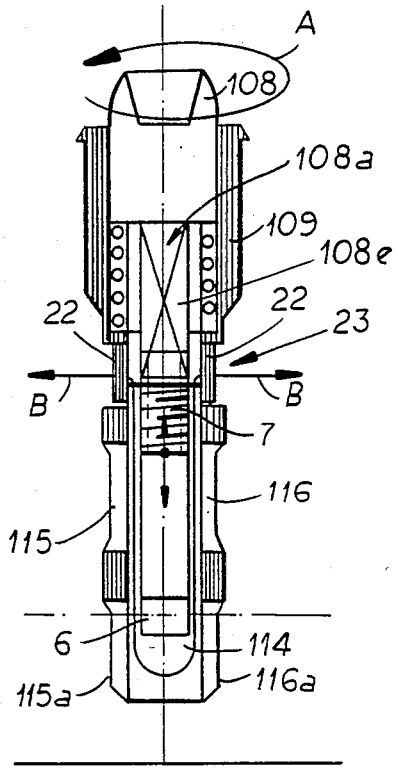
FIG. 4A is an axial sectional view through the sleeve of another bolt assembly according to the invention.
Figure 4B:
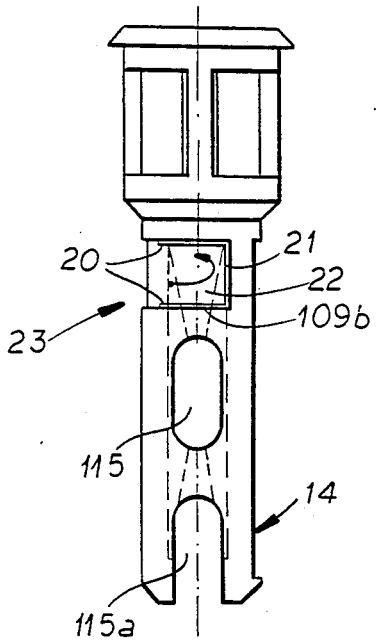
FIG. 4B is an elevational view of this sleeve.

As can be seen from FIGS. 4A and 4B, the sleeve 109 can be formed with a relatively long slot 114 as previously described, a short slot 115, 116 at right angles to it on each of two opposite sides of this sleeve and notches 115*a*, 116*a* as can be seen from FIG. 4A, all as has been described previously.

The bolt pin 108 is formed along its shank 108*a* with flats 108*e* at two diametrically opposite sides thereof, these flats being engaged by corresponding flats 109*b* in the sleeve to prevent undesired rotation of the bolt. At least part of each flat 109*a* is formed by a spring biased flap 22 formed on the wall of the sleeve by a pair of generally circumferential slits 20 and an axial gap 21 so that the flaps 22 are deflectable outwardly when the bolt 108 is drawn outwardly to a degree sufficient for the inner end of the flats 108*e* to clear the fixed portions of the flats on the sleeve whereby only the flats on the flaps 22 remain to hold the bolt against rotation. In this position the bolt can be rotated against the biasing force of the flaps which always index the bolt in an effective position once rotation has been completed.

Each turn of the bolt, of course, axially displaces the bolt relative to the screw 7 which is formed with the hook 6 as previously described. In this case, therefore, the axial adjustment is effected by rotation of the bolt while the hook and the screw remain engaged with the eccentric pin 4. The reference numeral 23 represents the spring region of the flaps. The rotation of the bolt head 108 for adjustment purposes has been shown by arrow A and the outward deflection of the spring flaps as represented by arrows B in FIG. 4A.

Mention may be made of the fact that in FIG. 4A the bolt 108 is shown rotated by 90° from its locked position in which the flaps 22 engage the flats on the shank of the bolt. Of course for operation, the bolt must be rotated through another 90° until the flats of sleeve and shank again interengage.

Figure 5:
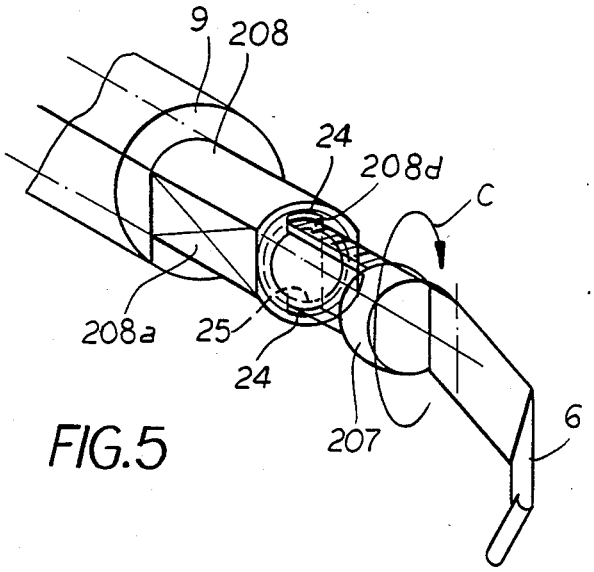
FIG. 5 is a diagrammatic perspective view illustrating the operation of the assembly of this embodiment.

In the embodiment of FIG. 5, it can be seen that the shank 208*a* of the bolt 208 has two diametrically opposite, inwardly open axial grooves 24 formed in the internal thread 208*d*, while the external thread of the screw 207 is formed on ribs 25 which are externally threaded but can pass axially freely along the grooves. In the relative angular position of the screw 207 carrying the hook 6 as previously described, it is possible to thrust the screw into the bolt pin to the desired position and then rotate the screw through, say 90° as represented by the arrow C. Fine adjustment can be accomplished by rotating the screw through additional turns in one or the other direction.

I claim:

1. A bolt assembly for a door set, said assembly comprising:

a bolt guide sleeve;

a bolt pin mounted to be axially displaceable in said sleeve, said bolt pin having a latching head adapted to project from said sleeve and engage in a recess, and a tubular shank extending from said head in said sleeve;

a coil spring disposed in said sleeve and bearing against said head for yieldably urging said head out of said sleeve;

a screw threadedly engaged in said shank and axially displaceable therein by rotation of said screw relative to said bolt pin;

at least one knob rotatably mounted on said assembly; and an eye formed unitarily on said screw and extending therefrom away from said head for engagement with a formation connected to said knob and excentric with respect to an axis of rotation thereof whereby rotation of said knob can displace said head against a force of said spring.

2. The bolt assembly defined in claim 1 wherein said eye has a transition region at which it merges with said screw and which is of reduced cross section.

3. The bolt assembly defined in claim 1 wherein said screw has a head at which the eye is formed thereon and which is provided with at least one slot engageable by a screwdriver.

4. The bolt assembly defined in claim 1 wherein said screw has an end received in said bolt pin which is of reduced cross section.

5. The bolt assembly defined in claim 4 wherein said bolt pin has an axially throughgoing bore opening at said head, said end of said screw which is of reduced cross section being provided with at least one slot adapted to receive a screwdriver inserted through said throughgoing bore in said head.

6. The bolt assembly defined in claim 4 wherein said bolt guide sleeve is provided with an elongated window in a wall thereof dimensioned to permit insertion of said screw into said sleeve and into threaded engagement with said shank, and with a pair of elongated holes adapted to be traversed by respective connecting screws of a door plate on which said knob is rotatably mounted.

7. The bolt assembly defined in claim 1 wherein said bolt pin is provided with a flat and said sleeve has at least one flat complementary to the flat on said bolt pin for preventing rotation of said bolt pin relative to said sleeve upon engagement of said flats.

8. The bolt assembly defined in claim 1 wherein said flat on said sleeve is formed by an elastic flap bearing resiliently upon said bolt pin and defined by a pair of axially spaced radial slits and an axial gap interconnecting said slits.

9. The bolt assembly defined in claim 8 wherein said bolt pin is provided with a pair of diametrically opposite flats and two of said flaps are provided on said sleeve for resilient engagement respectively with the flats of said bolt pin, said flaps extending at least over the angular extent of said flats.

10. The bolt assembly defined in claim 8 wherein said shank has an internal thread receiving said screw and provided with a plurality of axially extending inwardly open grooves interrupting said internal thread, said screw being formed with a male thread on a plurality of ribs equal in number to that of said grooves and receivable therein in a given relative angular orientation of said shank and said screw permitting axial insertion of said screw in said shank to a desired distance and then permitting relative rotation of said screw and said shank to adjust the relative axial positions thereof.

11. The bolt assembly defined in claim 8 wherein said eye is a hook and is partially open to engage over said formation.

12. The bolt assembly defined in claim 8 wherein said eye is completely closed around said formation.

13. The bolt assembly defined in claim 1 wherein said eye is a hook and is partially open to engage over said formation.

14. The bolt assembly defined in claim 1 wherein said eye is completely closed around said formation.

15. The bolt assembly defined in claim 8 wherein said eye has a transition region at which it merges with said screw and which is of reduced cross section.

16. The bolt assembly defined in claim 8 wherein said screw has a head at which the eye is formed thereon and which is provided with at least one slot engageable by a screwdriver.

17. The bolt assembly defined in claim 8 wherein said screw has an end received in said bolt pin which is of reduced cross section.

18. The bolt assembly defined in claim 15 wherein said bolt pin has an axially throughgoing bore opening at said head, said end of said screw which is of reduced cross section being provided with at least one slot adapted to receive a screwdriver inserted through said head into said throughgoing bore.

* * * * *